US011302456B2

(12) United States Patent
Scott et al.

(10) Patent No.: US 11,302,456 B2
(45) Date of Patent: Apr. 12, 2022

(54) RADIATION POWERED DEVICES COMPRISING DIAMOND MATERIAL AND ELECTRICAL POWER SOURCES FOR RADIATION POWERED DEVICES

(71) Applicant: The University of Bristol, Bristol (GB)

(72) Inventors: Thomas Scott, Bristol (GB); Neil Fox, Bristol (GB); Liam Payne, Bristol (GB); Chris Hutson, Bristol (GB); Hugo Dominguez Andrade, Bristol (GB)

(73) Assignee: The University of Bristol, Bristol (GB)

( * ) Notice: Subject to any disclaimer, the term of this patent is extended or adjusted under 35 U.S.C. 154(b) by 70 days.

(21) Appl. No.: 16/612,513

(22) PCT Filed: May 10, 2018

(86) PCT No.: PCT/GB2018/051258
§ 371 (c)(1),
(2) Date: Nov. 11, 2019

(87) PCT Pub. No.: WO2018/206958
PCT Pub. Date: Nov. 15, 2018

(65) Prior Publication Data

US 2020/0203033 A1 Jun. 25, 2020

Related U.S. Application Data

(60) Provisional application No. 62/504,012, filed on May 10, 2017.

(30) Foreign Application Priority Data

May 10, 2017 (GB) ..... 1707486

(51) Int. Cl.
*G21H 1/06* (2006.01)
*G21H 1/02* (2006.01)

(52) U.S. Cl.
CPC ..... *G21H 1/06* (2013.01); *G21H 1/02* (2013.01)

(58) Field of Classification Search
CPC ..... G21H 1/06; G21H 1/02
USPC ..... 310/303
See application file for complete search history.

(56) References Cited

U.S. PATENT DOCUMENTS

| | | | | |
|---|---|---|---|---|
| 5,859,484 | A | 1/1999 | Mannik et al. | |
| 6,753,469 | B1 | 6/2004 | Kolawa et al. | |
| 8,492,681 | B2 | 7/2013 | Satanek | |
| 2009/0026879 | A1* | 1/2009 | Prelas | G21H 1/06 310/303 |

(Continued)

FOREIGN PATENT DOCUMENTS

| | | | |
|---|---|---|---|
| JP | 2002510035 | A | 4/2002 |
| JP | 2008058137 | A | 3/2008 |

(Continued)

OTHER PUBLICATIONS

ISRWO of corresponding PCT/GB2018/051258 dated Sep. 27, 2018.

(Continued)

*Primary Examiner* — John K Kim
(74) *Attorney, Agent, or Firm* — Vorys, Sater, Seymour and Pease LLP

(57) ABSTRACT

Provided herein is a radiation powered device comprising a semiconductor comprising a diamond material.

13 Claims, 6 Drawing Sheets

(56) References Cited

U.S. PATENT DOCUMENTS

| | | | | |
|---|---|---|---|---|
| 2011/0031572 | A1 | 2/2011 | Spencer et al. | |
| 2012/0133244 | A1* | 5/2012 | Spencer | G21H 1/02 310/303 |
| 2013/0033148 | A1 | 2/2013 | Thomas | |
| 2013/0264907 | A1 | 10/2013 | Lee et al. | |
| 2015/0380582 | A1* | 12/2015 | Gaspari | H01L 31/035218 136/244 |
| 2016/0086680 | A1* | 3/2016 | Filler | G21B 1/11 60/203.1 |
| 2020/0203033 | A1* | 6/2020 | Scott | G21H 1/02 |

FOREIGN PATENT DOCUMENTS

| | | | |
|---|---|---|---|
| JP | 2008296089 | A | 12/2008 |
| JP | 2012520466 | A | 9/2012 |
| JP | 2015049111 | A | 3/2015 |
| KR | 20140129404 | A | 11/2014 |
| RU | 2595772 | C1 | 8/2016 |
| WO | 99/36967 | A1 | 7/1999 |
| WO | 9936967 | A1 | 7/1999 |
| WO | 2001096633 | A1 | 12/2001 |
| WO | 2009044882 | A1 | 9/2009 |
| WO | 2018206958 | A1 | 11/2018 |

OTHER PUBLICATIONS

IPRP of related PCT/GB2018/051258 dated Nov. 21, 2019.

Combined Search and Examination Report of corresponding GB1707486.5 with report date of Aug. 16, 2017.

D.M. Trucchi, E. Cappelli, and P. Ascarelli;Designing CVD Diamond Betavoltaic Batteries; CNR-ISC (Institute of Complex Systems); Via Salaria km 29.300, 00016 Monterotondo Scalo (RM)—Italy;Conference Paper—Jan. 2009.

C. Delfaure, M. Pomorski, J. De Sanoit, P. Bergonzo, and S. Saada; Single crystal CVD diamond membranes for betavoltaic cells; Appl. Phys. Lett. 108, 252105 (2016).

Tarelkin, Sergey et al.; Comparative study of different metals for Schottky barrier diamond betavoltaic power converter by EBIC technique; Phys. Status Solidi A 213, No. 9, 2492-2497 (2016) / DOI 10 1002/pssa.201533060; Published online May 10, 2016.

University of Bristol; News and features article; 'Diamond-age' of power generation as nuclear batteries developed; press release issued: Nov. 25, 2016.

Yan et al., Quantitative study on graphitization and optical absorption of CVD diamond films after rapid heating treatment; Institute for Advanced Materials and Technology, University of Science and Technology Beijing, Beijing, PR China; Diamond & Related Materials 87 (2018) 267-273;Apr. 14, 2018; 0925-9635/ © 2018 Elsevier B.V.

Taki et al., "XPS structural characterization of hydrogenated amorphous carbon thin films prepared by shielded arc ion plating", Thin Solid Films, vol. 316, Issues 1-2, Mar. 21, 1998, pp. 45-50.

Frank et al., in "Determination of thermal conductivity and specific heat by a combined 3ω/decay technique", Review of Scientific Instruments vol. 64, No. 3, 760-765; Marchi 993.

Watanabe, H. et al., "Isotope composition dependence of the bandgap energy in diamond"; American Physical Society; Physical Review B 88, 205420-1-205420-5, Nov. 2013.

Office action issued in corresponding JP Application No. 2019-562264 dated Nov. 2, 2021.

* cited by examiner

RADIATION POWERED DEVICES COMPRISING DIAMOND MATERIAL AND ELECTRICAL POWER SOURCES FOR RADIATION POWERED DEVICES

FIELD OF INVENTION

The present invention is directed to radiation powered devices comprising diamond material, and electrical power sources for radiation powered devices.

BACKGROUND OF INVENTION

One of the alternatives to current battery technology is the use of radiation powered batteries, also known as atomic batteries, nuclear batteries, radioisotope batteries, or radioisotope generators. These devices directly convert nuclear decay products (e.g. alpha or beta particles or gamma radiation) into electricity.

Various device structures and materials have been developed to extract electrical energy from nuclear sources. Methods can generally be grouped into two main types: thermal and non-thermal. In thermal devices the radioactive source heats up a cathode electrode causing emission of electrons which flow to a cooler anode electrode generating electricity, e.g. thermoelectric or thermionic generators. In non-thermal devices radioactive decay products from a radioactive source generate electron-hole pairs in a semiconductor disposed adjacent the radioactive source in order to generate electricity, e.g. alphavoltaic or betavoltaic devices. Thermal and non-thermal processes can also be combined in device structures using both a thermal gradient and radiation induced electron-hole pair generation to produce electricity.

Compared to chemical battery technologies, radioisotope batteries tend to have low power output. However, they have the advantage of long lifetimes, reduced size, and high energy density. As such, they are useful as power sources for equipment that must operate for long periods of time, particularly in environments which are difficult to access such as spacecraft, medical implants (e.g. pacemakers), underwater systems, automated scientific stations in remote parts of the world, high radiation environments, harsh chemical or physical environments, etc. They are also useful as power sources in miniaturized systems where the size of the power source is of importance. Examples of several prior art radioisotope batteries are briefly discussed below.

US2013264907 (A1) discloses a betavoltaic battery which includes a beta particle source configured to provide beta particles and a diamond moderator configured to convert at least some of the beta particles into lower-energy electrons. The betavoltaic battery further includes a PN junction configured to receive the electrons and to provide electrical power to a load. The diamond moderator is located between the beta particle source and the PN junction. The beta source is comprised of tritium, nickel, krypton, promethium or strontium-yttrium isotopes which can be embedded in a substrate adjacent the diamond moderator. The PN junction is formed using a semiconductor such as silicon, silicon carbide, gallium nitride, boron nitride, or other materials with suitable p-type and n-type dopants.

US2013033149 (A1) discloses a betavoltaic cell that has been fabricated using a semiconductor that includes, but is not limited to, Silicon Carbide (SiC), Silicon (Si), Gallium Arsenide (GaAs), Indium Gallium Arsenide (InGaAs), Gallium Nitide (GaN), Gallium Phosphide (GaP), or Diamond, and uses through wafer via holes or other fabrication techniques to form both positive (+ve) and negative (−ve) contacts on the front and back sides of the cell. A beta radiation source is provided as a separate layer or incorporated into a substrate adjacent the semiconductor. The beta radiation source is selected from Phosphorus-33, Ni-63, Promethium, and Tritium.

US2011031572 (A1) discloses a betavoltaic battery comprising a semiconductor that includes, but is not limited to, Si, GaAs, GaP, GaN, diamond, and SiC. Tritium is referenced as an exemplary beta radiation source and SiC is referenced as an exemplary semiconductor material. The beta radiation source is provided as a separate layer or incorporated into a substrate adjacent the semiconductor. The beta radiation source is selected from Phosphorus-33, Ni-63, Promethium, and Tritium.

"Designing CVD Diamond Betavoltaic Batteries" (https://www.researchgate.net/publication/235130192) discloses that diamond is a wide band-gap semiconductor characterized by exceptional physical properties and represents an appropriate material for applications involving the use of intense beams of high-energy (hv) radiation and electrons. It is disclosed that devices are being designed for the conversion of high-energy radiation into electrical power. Specifically, it is disclosed that efforts are focused on the interaction between diamond and beta particles which are simulated using an electron beam rather than a radioisotope.

"Single crystal CVD diamond membranes for betavoltaic cells" (http://dx.doi.org/10.1063/1.4954013) discloses a single crystal diamond large area thin membrane assembled as a p-doped/Intrinsic/Metal (PIM) structure and used in a betavoltaic configuration. Beta particles are simulated using an electron beam rather than a radioisotope.

"Comparative study of different metals for Schottky barrier diamond betavoltaic power converter by EBIC technique" (http://onlinelibrary.wiley.com/doi/10.1002/pssa.201533060/abstract) discloses betavoltaic converters based on synthetic IIb diamond Schottky structures. The structures were tested using an electron beam rather than a radioisotope.

RU2595772 (C1) discloses a radioisotope photo-thermoelectric generator comprising a closed gas-dynamic circuit with working gas-xenon, a radioisotope radiator, photo- and thermoelectric converters, heat-eliminating plates and a radiator.

U.S. Pat. No. 5,859,484 (A) discloses a radioisotope-powered semiconductor battery. The battery comprises a substrate of a crystalline semiconductor material and a radioactive power source comprising at least one radioactive element. The power source is positioned relative to the substrate to allow for impingement of emitted particles on the substrate. It is disclosed that the radioactive element is preferably impregnated within or immediately adjacent the semiconductor material. The semiconductor material is selected from the group consisting of III-V and II-VI semiconductor materials and mixtures thereof. The radioactive element is selected from the group consisting of tritium, promethium-147, americium-241, carbon-14, krypton-85, cesium-137, radium-226 or -228, curium-242 or -244, and mixtures thereof.

KR20140129404 (A) discloses a radioisotope battery including a semiconductor layer, a seed layer which is formed on the semiconductor layer, a radioisotope layer which is formed on the seed layer, and a radiation shielding layer which is formed on the radioisotope layer and shields the radiation of the radioisotope layer from the outside. Ni-63 is used as the radiation source.

In light of the above, it is evident that various materials and device structures have been proposed in the art. However, there is still an ongoing need to provide radioisotope batteries which have improved performance including one or more of: electrical efficiency; electrical power output; safety and/or radiation leakage; inertness, toxicity and/or biocompatibility; and lifetime.

SUMMARY OF INVENTION

The present inventors have identified that diamond is in many ways the ideal material for use in radiation powered devices such as radioisotope batteries and related devices. First, diamond is extremely radiation hard and therefore has a higher tolerance to ionising radiation than other semiconductor materials improving stability and lifetime. Secondly, the large band-gap of diamond enables a significant improvement in the internal efficiency of the device. Thirdly, diamond is chemically inert, non-toxic, has high thermal conductivity, and is stable up to very high temperatures. Non-toxicity for example is highly important for human handling and sub-dermal implantation of devices for applications including pace makers and/or hearing aids.

As discussed in the background section, the possibility of using diamond material in radioisotope batteries has already been proposed in several documents, either as a moderating material in combination with another semiconductor material or as the active semiconductor component of the device. However, the present inventors have identified several problems with prior art configurations as discussed below.

First, diamond based devices discussed in the background section are configured such that the radioactive source is positioned outside of the diamond semiconductor material. This has been found to be an inefficient configuration for diamond based devices in terms of converting radiation into electron flow within the diamond material. Losses occur at surface interfaces and any air gaps. Furthermore, the dense atomic packing in the diamond structure means that radiation, such as alpha or beta radiation, does not effectively penetrate far through the diamond structure.

Secondly, because the radioactive source is positioned outside of the diamond material then such a configuration can be prone to radiation leakage.

Thirdly, because the radioactive source is positioned outside of the diamond material then the radioisotope material component may be damaged and leak from the device. This can lead to degradation in device performance, lack of chemical inertness, increased toxicity and/or biocompatibility issues.

Fourthly, the diamond based devices utilize tritium or heavy metal radiation sources. These can be prone to leakage and/or be highly toxic.

Fifthly, the configuration described in the background section have a low output voltage.

The aim of certain embodiments of the present invention is to at least partially solve one or more of these problems.

The term "diamond material" is used herein to refer to a material composed of diamond. The skilled person understands that diamond can be described as a crystalline material (a polycrystalline material or a single crystal material). The skilled person also understands that diamond can be described as the diamond allotrope of carbon in which carbon atoms are arranged in a cubic Bravais lattice over which is laid a four-atom tetrahedral motif. In certain embodiments, the diamond material may comprise n-type diamond (e.g. nitrogen doped diamond or phosphorous doped diamond) and/or p-type diamond (e.g. boron doped diamond). In certain embodiments the diamond material may comprise boron doped diamond.

The diamond material may contain at least about 90% $sp^3$ bonds, for example at least about 95% $sp^3$ bonds, at least about 97% $sp^3$ bonds, at least about 98% $sp^3$ bonds, at least about 99% $sp^3$ bonds, at least about 99.5% $sp^3$ bonds, at least about 99.9% $sp^3$ bonds, or about 100% $sp^3$ bonds. The $sp^3$ bond content in the diamond material may be determined by methods known to the skilled person, for example using X-ray photoelectron spectroscopy (XPS) (for example, as described by Yan et al., "Quantitative study on graphitization and optical absorption of CVD diamond films after rapid heating treatment", Diamond and Related Materials, 14 Apr. 2018 (available online at https://doi.org/10.1016/j.diamond.2018.04.011); or Taki et al., "XPS structural characterization of hydrogenated amorphous carbon thin films prepared by shielded arc ion plating", Thin Solid Films, Volume 316, Issues 1-2, 21 Mar. 1998, Pages 45-50).

The skilled person understands that diamond may have a single active Raman mode at 1332 $cm^{-1}$.

The diamond material may have a band gap at room temperature (about 25° C.) of greater than about 5.3 eV, or about 5.4 eV or greater, or about 5.5 eV.

The diamond material may have a thermal conductivity measured at room temperature (about 25° C.) of greater than about 100 W/mK, for example, greater than about 500 W/mK, greater than about 1000 W/mK, greater than about 1500 W/mK, or greater than about 2000 W/mK, or about 2200 W/mK or greater. Thermal conductivity of diamond may be determined according to the 3ω method (as described by Frank et al., in "Determination of thermal conductivity and specific heat by a combined 3ω/decay technique", Review of Scientific Instruments 64, 760 (1993)).

The diamond material may have a density of greater than about 3300 $kg/m^3$, for example greater than about 3400 $kg/m^3$, or greater than about 3500 $kg/m^3$.

According to a first configuration, a radiation powered device is provided which comprises:

- a first electrode;
- a second electrode;
- a semiconductor disposed between the first and second electrodes; and
- a radioactive source configured to generate a flow of electrons through the semiconductor between the first and second electrodes;
- wherein the semiconductor comprises diamond material; and
- wherein the radioactive source is embedded within the diamond material.

According to a second configuration, an electrical power source (e.g. a radioisotope electrical power source or a beta-emitting radioisotope electrical power source) is provided. The electrical power source may comprise a semiconductor comprising a diamond material and a radioactive source embedded within the diamond material, wherein the radioactive source comprises a beta-emitting radioisotope and atoms of the radioisotope are substitutionally or interstitially integrated into the diamond material.

The electrical power source may further comprise an ohmic contact as described herein. The ohmic contact may comprise a first electrode in contact with the semiconductor.

The electrical power source may further comprise a Schottky contact as described herein. The Schottky contact may comprise a second electrode in contact with the semiconductor.

The radiation powered devices and electrical power sources described herein may comprise a first electrode and a second electrode and a semiconductor disposed between the first electrode and the second electrode. The semiconductor may be disposed between first and second electrodes such that electrons may flow between the first and second electrodes via the semiconductor.

In certain embodiments, the semiconductor may comprise first and second opposing faces, the first electrode contacting the first face and the second electrode contacting the second face (e.g. such that the semiconductor disposed between the first and second electrodes is sandwiched between the first and second electrodes).

In certain embodiments, the semiconductor may be disposed between the first and second electrodes in any arrangement that allows electrons to flow between the first and second electrodes via the semiconductor. For example, the semiconductor may comprise first and second opposing faces, and the first and second electrodes may both contact the first face of the semiconductor.

In certain embodiments, provided herein is a radiation powered device comprising an electrical power source as described herein.

In certain embodiments, the radiation powered device is a battery, e.g. a betavoltaic battery.

Also described herein is a battery, e.g. a betavoltaic battery, comprising an electrical power source described herein.

In certain embodiments, the semiconductor comprises diamond material comprising p-type diamond and diamond material comprising n-type diamond such that the semiconductor comprises a p-n junction.

According to a third configuration, a radiation powered device is provided which comprises:

a first electrode;

a second electrode; and a semiconductor disposed between the first and second electrodes, wherein the semiconductor comprises diamond material which generates a flow of electrons between the first and second electrodes when exposed to radiation, and wherein the diamond material includes a $^{13}C$ diamond region which comprises isotopically purified diamond material having an increased $^{13}C$ content compared to natural isotopic abundance.

According to a fourth configuration, an electrical power source is provided which comprises a semiconductor comprising a diamond material and a radioactive source embedded within the diamond material, wherein the radioactive source comprises a beta-emitting radioisotope and atoms of the radioisotope are substitutionally or interstitially integrated into the diamond material, and the diamond material comprises a $^{13}C$ diamond region which comprises isotopically purified diamond material having an increased $^{13}C$ content compared to natural isotopic abundance.

According to a fifth configuration, a radiation powered device is provided which comprises:

a first electrode;

a second electrode;

a semiconductor disposed between the first and second electrodes; and a radioactive source configured to generate a flow of electrons through the semiconductor between the first and second electrodes;

wherein the semiconductor comprises diamond material; and wherein the radioactive source is formed of $^{14}C$.

According to a sixth configuration, an electrical power source is provided which comprises a semiconductor comprising a diamond material and a radioactive source embedded within the diamond material, wherein the radioactive source comprises $^{14}C$ atoms which are substitutionally integrated into the diamond material.

According to a seventh configuration, a radiation powered device is provided which comprises:

a first electrode;

a second electrode; and a semiconductor disposed between the first and second electrodes, wherein the semiconductor comprises diamond material which generates a flow of electrons between the first and second electrodes when exposed to radiation without the application of a biasing voltage, and wherein the radiation powered device further comprises a charge storage device coupled to the first and second electrodes for storing charge flowing out of the diamond material.

The radioactive source may comprise radioisotopes, for example, beta-emitting radioisotopes. Examples of beta-emitting radioisotopes are tritium, $^{14}C$, $^{10}Be$ and $^{33}P$.

In certain embodiments, the radioactive source comprises tritium, $^{14}C$, $^{10}Be$, and/or $^{33}P$. In certain embodiments, the radioactive source comprises tritium, $^{14}$ and/or $^{10}Be$. In certain embodiments, the radioactive source comprises $^{14}C$ and/or $^{10}Be$. In certain embodiments, the radioactive source comprises $^{14}C$ and/or tritium. In certain embodiments, the radioactive source comprises $^{14}C$.

The radioactive source may be embedded within the diamond material such that, for example, atoms of a radioisotope of the radioactive source are either substitutionally or interstitially integrated into the diamond material, that is substitutionally or interstitially integrated into the crystal lattice of the diamond material, to form a constituent part of the diamond material. For example, the semiconductor may comprise diamond material with $^{14}C$ and/or $^{10}Be$ substitutionally integrated into the diamond material, and/or the semiconductor may comprise diamond material with tritium interstitially integrated into the diamond material. In certain embodiments, atoms of a radioisotope, e.g. tritium, of the radioactive source may also be entrapped on grain boundaries (if present) within the diamond material.

In certain embodiments the diamond material in which a radioactive source is embedded is a synthetic diamond material in which the radioactive source (e.g. radioisotopic atoms) is integrated during formation of the diamond material. For example, tritium and/or $^{14}C$ may be integrated into the diamond crystal lattice during formation of the diamond material.

In certain embodiments, the diamond material may comprise $^{13}C$ such that the $^{13}C$ content of the diamond material comprises an increased $^{13}C$ content compared to natural isotopic abundance of $^{13}C$.

In certain embodiments, the diamond material includes a $^{13}C$ diamond region which comprises isotopically purified diamond material having an increased $^{13}C$ content compared to natural isotopic abundance.

In certain embodiments, the diamond material comprises a $^{13}C$ diamond layer, where the $^{13}C$ diamond layer is a layer of diamond material comprising $^{13}C$ such that the $^{13}C$ content of the $^{13}C$ diamond layer comprises an increased $^{13}C$ content compared to natural isotopic abundance of $^{13}C$. In certain embodiments, the diamond material comprises a $^{13}C$ diamond layer which is positioned at an outer surface of the diamond material.

In certain embodiments, the diamond material comprising $^{13}C$ is a synthetic diamond material in which $^{13}C$ is integrated during formation of the diamond material. In certain embodiments, the diamond material is a synthetic diamond material in which $^{13}C$ and a radioactive source (e.g. radioisotope atoms) are integrated during formation of the diamond material.

In certain embodiments, the diamond material comprises a $^{12}C$ diamond region. In certain embodiments, the $^{12}C$ diamond region is a $^{12}C$ diamond layer. The In certain embodiments, the diamond material comprises a $^{12}C$ diamond layer. The term "$^{12}C$ diamond" may be used herein to refer to diamond material comprising a substantially natural abundance of carbon isotopes. In certain examples, the $^{12}C$ diamond region/layer comprises boron-doped $^{12}C$ diamond, i.e. the diamond material may comprise a boron-doped $^{12}C$ diamond region/layer.

In certain embodiments, the diamond material comprises $^{14}C$ diamond. In certain embodiments, the diamond material comprises a $^{14}C$ diamond region. In certain embodiments, the diamond material comprises a $^{14}C$ diamond layer. The term "$^{14}C$ diamond" may be used herein to refer to diamond material comprising atoms of $^{14}C$ substitutionally integrated within the diamond structure such that the $^{14}C$ content of the $^{14}C$ diamond comprises an increased $^{14}C$ content compared to natural isotopic abundance of $^{14}C$. In certain embodiments, the $^{14}C$ diamond also comprises an increased $^{13}C$ content compared to natural isotopic abundance of $^{13}C$.

In certain embodiments, the diamond material comprises a $^{12}C$ diamond region, a $^{14}C$ diamond region, and/or a $^{13}C$ diamond region. The $^{12}C$ diamond, $^{14}C$ region, and/or $^{13}C$ diamond regions of the diamond material may be described as isotopic regions within a continuous diamond crystal lattice (i.e. as opposed to a structure with different regions with physical boundaries/discontinuous structures between the different regions.

In certain embodiments, the diamond material comprises a bi-layer structure. The bi-layer structure of the diamond material may be described as isotopic layers within a continuous diamond crystal lattice (i.e. as opposed to a bi-layer structure comprising a discontinuous structure (or a physical boundary) across the two layers).

In certain embodiments, a diamond material having a bi-layer structure may comprise a layer of diamond in which a radioactive source is embedded (for example, a layer of diamond in which atoms of a radioisotope (such as $^{14}C$) are substitutionally or interstitially integrated) and a layer of $^{12}C$ diamond.

In certain embodiments, a diamond material having a bi-layer structure may comprise a $^{14}C$ diamond layer and a $^{12}C$ diamond layer (e.g. a boron-doped $^{12}C$ diamond layer).

In certain embodiments, a diamond material having a bi-layer structure may comprise a layer of diamond in which a radioactive source is embedded (for example, a layer of diamond in which atoms of a radioisotope (such as $^{14}C$) are substitutionally or interstitially integrated) and a $^{13}C$ diamond layer.

In certain embodiments, a diamond material having a bi-layer structure may comprise a $^{14}C$ diamond layer and a $^{13}C$ diamond layer.

In certain embodiments, the diamond material comprises a tri-layer structure. The tri-layer structure of the diamond material may be described as isotopic layers within a continuous diamond crystal lattice (i.e. as opposed to a tri-layer structure comprising a discontinuous structure (or physical boundaries) across the three layers).

In certain embodiments, the diamond material having a tri-layer structure may comprise a layer of diamond in which a radioactive source is embedded (for example, a layer of diamond in which atoms of a radioisotope (such as $^{14}C$) are substitutionally or interstitially integrated), a $^{12}C$ diamond layer (e.g. a boron-doped $^{12}C$ diamond layer) and a $^{13}C$ diamond layer. In certain embodiments, the diamond material having a tri-layer structure may comprise a $^{14}C$ diamond layer, a $^{12}C$ diamond layer and a $^{13}C$ diamond layer. In certain embodiments, the tri-layer structure may be arranged such that the $^{12}C$ diamond layer is positioned between the layer of diamond in which a radioactive source is embedded (e.g. the $^{14}C$ diamond layer) and the $^{13}C$ diamond layer.

In certain embodiments, the diamond material comprises a region comprising an embedded radioactive source (for example a $^{14}C$ diamond region or a $^{14}C$ diamond layer). In certain embodiments, the diamond material comprises a region comprising an embedded radioactive source (for example a $^{14}C$ diamond region or a $^{14}C$ diamond layer) and the first electrode contacts the region comprising the embedded radioactive source (for example the first electrode contacts the $^{14}C$ diamond region) of the diamond material of the semiconductor, for example to form an ohmic contact.

In certain embodiments, the diamond material comprises a bi-region structure. The bi-region structure of the diamond material may be described as isotopic regions within a continuous diamond crystal lattice (i.e. as opposed to a bi-region structure comprising a discontinuous structure (or a physical boundary) across the two regions).

In certain embodiments, a diamond material having a bi-region structure may comprise a region of diamond in which a radioactive source is embedded (for example, a region of diamond in which atoms of a radioisotope (such as $^{14}C$) are substitutionally or interstitially integrated) and a region of $^{12}C$ diamond.

In certain embodiments, a diamond material having a bi-region structure may comprise a $^{14}C$ diamond region and a $^{12}C$ diamond region (e.g. a boron-doped $^{12}C$ diamond region).

In certain embodiments, a diamond material having a bi-region structure may comprise a region of diamond in which a radioactive source is embedded (for example, a layer of diamond in which atoms of a radioisotope (such as $^{14}C$) are substitutionally or interstitially integrated) and a $^{13}C$ diamond region.

In certain embodiments, a diamond material having a bi-region structure may comprise a $^{14}C$ diamond region and a $^{13}C$ diamond region.

In certain embodiments, the diamond material comprises a tri-region structure. The tri-region structure of the diamond material may be described as isotopic regions within a continuous diamond crystal lattice (i.e. as opposed to a tri-region structure comprising a discontinuous structure (or physical boundaries) across the three regions).

In certain embodiments, the diamond material having a tri-region structure may comprise a region of diamond in which a radioactive source is embedded (for example, a region of diamond in which atoms of a radioisotope (such as $^{14}C$) are substitutionally or interstitially integrated), a $^{12}C$ diamond region (e.g. a boron-doped $^{12}C$ diamond region) and a $^{13}C$ diamond region. In certain embodiments, the diamond material having a tri-region structure may comprise a $^{14}C$ diamond region, a $^{12}C$ diamond region and a $^{13}C$ diamond region. In certain embodiments, the tri-region structure may be arranged such that the $^{12}C$ diamond region is positioned between the region of diamond in which a radioactive source is embedded (e.g. the $^{14}C$ diamond region) and the $^{13}C$ diamond region.

In certain embodiments, the $^{12}C$ diamond region is a $^{12}C$ diamond layer.

In certain embodiments, the $^{13}C$ diamond region is a $^{13}C$ diamond layer.

In certain embodiments, the region of diamond in which a radioactive source is embedded is a layer of diamond in which a radioactive source is embedded.

In certain embodiments, the $^{14}C$ diamond region is a $^{14}C$ diamond layer.

In certain embodiments, the diamond material comprises a $^{13}C$ diamond region (e.g. a $^{13}C$ diamond layer) and a second electrode contacts the $^{13}C$ diamond region of the diamond material of the semiconductor, for example to form a Schottky contact.

In certain embodiments, the diamond material comprises a $^{12}C$ diamond region (e.g. a $^{12}C$ diamond layer) and a second electrode contacts the $^{12}C$ diamond region of the diamond material of the semiconductor, for example to form a Schottky contact.

In certain embodiments, the diamond material comprises a region in which a radioactive source is embedded (e.g. a $^{14}C$ diamond region or layer) and a first electrode contacts the region in which a radioactive source is embedded (e.g. a $^{14}C$ diamond region or layer) of the diamond material of the semiconductor, for example to form an ohmic contact.

In certain embodiments, the diamond material of the semiconductor comprises $^{14}C$ diamond and a first electrode contacts the $^{14}C$ diamond of the diamond material to form an ohmic contact and a second electrode contacts the $^{14}C$ diamond of the diamond material to form a Schottky contact.

In certain embodiments, the diamond material of the semiconductor comprises a diamond region in which a radioactive source is embedded (e.g. a $^{14}C$ diamond region or layer), and a $^{12}C$ diamond region (e.g. a boron doped $^{12}C$ diamond region), and a first electrode contacts the diamond region in which a radioactive source is embedded (e.g. a $^{14}C$ diamond region or layer) to form an ohmic contact and a second electrode contacts the $^{12}C$ diamond region to form a Schottky contact.

In certain embodiments, the diamond material of the semiconductor comprises a diamond region in which a radioactive source is embedded (e.g. a $^{14}C$ diamond region or layer), and a $^{13}C$ diamond region, and a first electrode contacts the diamond region in which a radioactive source is embedded (e.g. a $^{14}C$ diamond region or layer) to form an ohmic contact and a second electrode contacts the $^{13}C$ diamond region to form a Schottky contact.

In certain embodiments, the diamond material of the semiconductor comprises a diamond region in which a radioactive source is embedded (e.g. a $^{14}C$ diamond region or layer), a $^{12}C$ diamond region (e.g. a boron doped $^{12}C$ diamond region) and a $^{13}C$ diamond region, and a first electrode contacts the diamond region in which a radioactive source is embedded (e.g. a $^{14}C$ diamond region or layer) to form an ohmic contact and a second electrode contacts the $^{13}C$ diamond region to form a Schottky contact.

The present inventors have found that embedding a radioactive source, for example a beta-emitting radioisotope, into a diamond material such that atoms of a radioisotope of the radioactive source are either substitutionally or interstitially integrated into the diamond material (that is substitutionally or interstitially integrated into the crystal lattice of the diamond material, to form a constituent part of the diamond material) advantageously provides a sealed (and therefore safe) and long life electrical power source. The inventors have also found that embedding a radioactive source in a diamond material such that atoms of a radioisotope of the radioactive source are either substitutionally or interstitially integrated into the diamond material also provides a power source having improved efficiency) due to atoms of a radioactive isotope of the radioactive source being positioned within the continuous crystal lattice of the diamond material which provides a structure in which there is no break in the atomic architecture between the emitting and collecting material) compared to conventional systems which exhibit a physical gap or discontinuous structure between the radioactive source and the collecting material.

The aforementioned configurations can be combined in various ways according to requirements and details of several specific configurations are given in the detailed description of this specification. It may also be noted that certain features of diamond based radiation powered devices have been disclosed by the present inventors [see, for example, http://www.bristol.ac.uk/news/2016/November/diamond-power.html and https://en.wikipedia.org/wiki/Diamond_battery]. However, details for putting the present invention into effect have not been disclosed by the inventors prior to filing of the present specification.

BRIEF DESCRIPTION OF THE DRAWINGS

Embodiments of the present invention are described by way of example only with reference to the accompanying drawings in which.

It should be noted that in the drawings like reference numerals have been used for corresponding components to illustrate common features of the various device configurations.

DETAILED DESCRIPTION

Device Configurations

Figure 1:
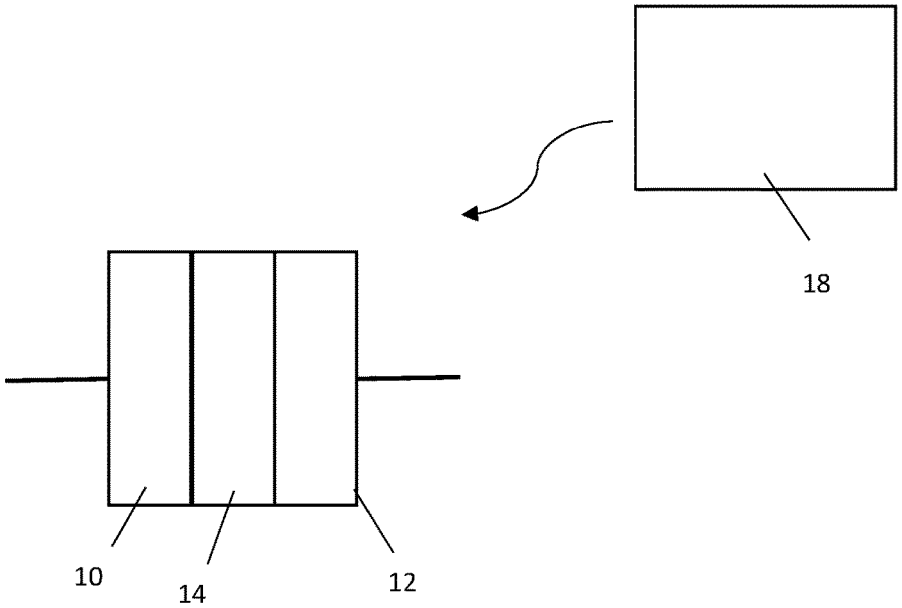
FIG. 1 shows a configuration of a radiation powered device utilizing an external radiation power source.

FIG. 1 shows a radiation powered device which comprises:

a first electrode 10;

a second electrode 12; and a semiconductor 14 disposed between the first and second electrodes, wherein the semiconductor comprises diamond material which generates a flow of electrons between the first and second electrodes when exposed to radiation.

An external radiation source 18, such as a gamma-radiation source, is shown in the configuration of FIG. 1 with the device placed in a radiation field such that electron-hole pairs are generated in the diamond material. The device may be placed adjacent the radiation source 18 or configured to surround the radiation source, e.g. by providing a cylindrical device structure within which the radiation source is disposed.

Figure 2A:
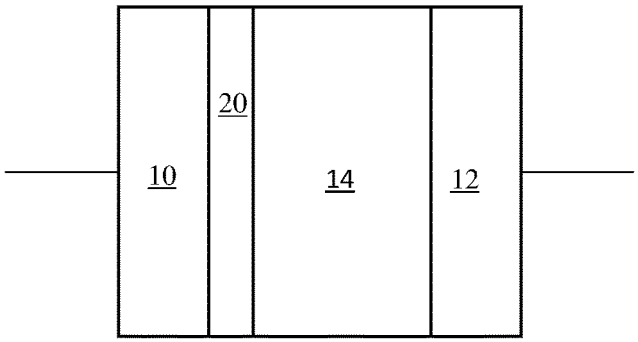
FIG. 2*a* shows a configuration of a radiation powered device utilizing an internal radiation power source.

An alternative to the external radiation source is to provide a radioisotope within the layered device structure as illustrated in the FIG. 2*a* which shows a radiation powered device comprising:

a first electrode 10;

a second electrode 12;

a semiconductor 14 disposed between the first and second electrodes; and a radioactive source 20 configured to generate a flow of electrons through the semiconductor between the first and second electrodes, wherein the semiconductor comprises diamond material.

Figure 10:
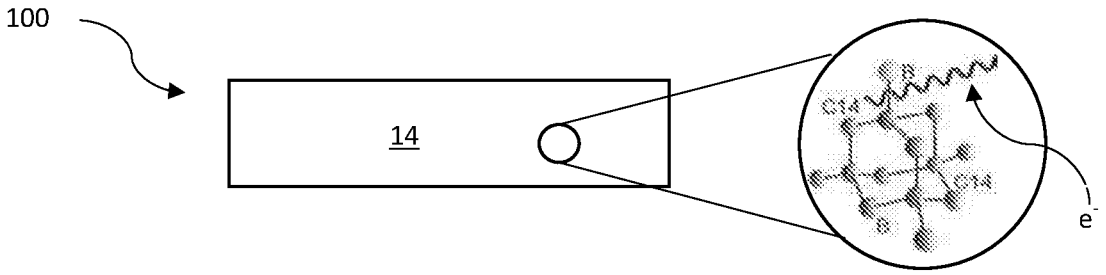
FIG. 10 is a pictorial representation of a radioisotope electrical power source.
Figure 11:
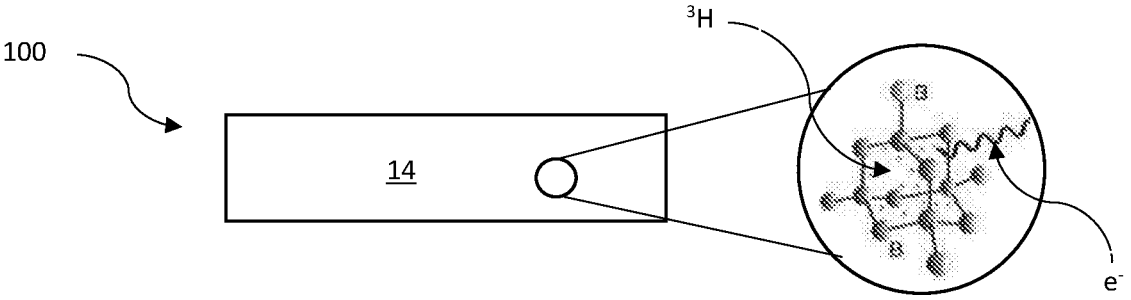
FIG. 11 is a pictorial representation of a radioisotope electrical power source.

The radioactive source 20 can be embedded within the diamond material rather than provided as a separate layer of material (see for examples the pictorial representations of the semiconductor shown in FIGS. 10 and 11). It has been found that if the radioactive source is embedded within the diamond material then losses associated with surface interfaces, air gaps, and limited penetration into the diamond structure are reduced. This provides much higher energy conversion efficiency than previous devices. Furthermore, the dense atomic packing in the diamond structure means that radiation does not effectively escape from the diamond material thus reducing radiation leakage. The embedded radioactive source may be, for example, tritium, $^{14}C$, $^{10}Be$, or Phosphorus-33; or tritium, $^{14}C$, or $^{10}Be$, more preferably tritium and/or $^{14}C$. While it is possible to encapsulate relatively small radioisotopes such as tritium, $^{14}C$, $^{10}Be$ and phosphorus-33 into the diamond lattice, the present inventors have found that it is difficult to incorporate larger atoms into the high atomic number density diamond lattice without causing significant damage to the diamond crystal structure which negatively impacts electronic charge transporting performance. The present inventors have found that embedding $^{14}C$, $^{10}Be$ and/or tritium into the diamond material is particularly advantageous in terms of providing a diamond material in which a radioactive source is embedded whilst also maintaining the diamond crystal structure.

Figure 2B:
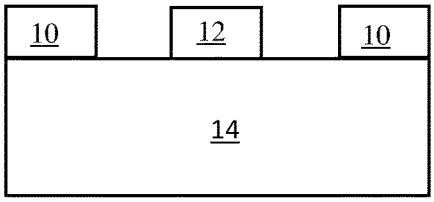
FIG. 2*b* shows a configuration of a radiation powered device utilizing an internal radiation power source.

FIG. 2*b* shows a radiation powered device similar to the device described in FIG. 2*a*, although the device of FIG. 2*b* has an alternative arrangement. The device of FIG. 2*b* comprises a semiconductor 14 comprising a diamond material in which a radioactive source is embedded. Both of the devices shown in FIGS. 2*a* and 2*b* comprise a semiconductor having first and second opposing faces. In the device shown in FIG. 2*a*, the first electrode 10 contacts a first face of the semiconductor and the second electrode 12 contacts the second face of the semiconductor. In the device shown in FIG. 2*b*, both the first and second electrodes 10, 12 contact a first face of the semiconductor. Both arrangements shown in FIGS. 2*a* and 2*b* allow electrons to flow between the first and second electrodes via the semiconductor.

Furthermore, encapsulation of the radioisotope material within the hard, chemically inert diamond structure reduces the possibility of damage and leakage of radioactive material from the device thus improving device stability and performance and increasing the robustness and chemical inertness of the device thus reducing problems associated with toxicity and/or biocompatibility.

An additional advantage of using tritium or $^{14}C$ is that both hydrogen and carbon are conventionally used in a diamond synthesis process and readily incorporate into the diamond lattice during synthesis. Accordingly, introducing tritium (a hydrogen isotope) and/or $^{14}C$ into the diamond synthesis process will not unduly affect the diamond synthesis chemistry.

Yet a further advantage of using tritium or $^{14}C$ is that they are both bi-products of nuclear power plants. Using this approach, radioactive bi-products of nuclear power plants can be encapsulated into diamond material to render them safe and the resultant diamond material utilized to construct radioisotope batteries thus converting problematic waste materials into a useful power source.

The diamond material optionally has a layered structure with at least one layer comprising the radioactive source and at least one layer which does not comprise the radioactive source. The layered structure may have a plurality of layers comprising the radioactive source and a plurality of layers which do not comprise the radioactive source. Such a layered structure enables the provision of thin layers of diamond material comprising a radioactive source separated by diamond layers which do not have the radioactive source. This can be advantageous as radiation does not penetrate far through the diamond lattice and so a layered structure can provide alternating layers of charge generating material and charge propagation and/or charge multiplication material. For example, the radioactive source can be provided in a layer or layers of diamond having a thickness in a range 50 nanometres to 150 micrometres, optionally 500 nanometres to 50 micrometres.

The layer(s) of diamond material comprising the radioactive source may be a layer(s) of diamond material in which atoms of a radioisotope of the radioactive source are either substitutionally or interstitially integrated into the diamond material (that is substitutionally or interstitially integrated into the crystal lattice of the diamond material, to form a constituent part of the diamond material).

In certain embodiments, the diamond material comprises a plurality of regions, where the plurality of regions are isotopic regions within the diamond material (i.e. isotopic regions within the continuous crystal lattice of the diamond material).

In certain embodiments, the diamond material comprises a plurality of layers, where the plurality of layers are isotopic layers within the diamond material (i.e. isotopic layers within the continuous crystal lattice of the diamond material).

It will be appreciated that the natural abundance of carbon isotopes is approximately 98.9% $^{12}C$, 1.1%'$^{13}C$ and a trace amount of $^{14}C$ (approximately 1 part per trillion). When we talk about $^{14}C$ configured to generate a flow of electrons through diamond material, the $^{14}C$ concentration must be significantly higher than the 1 part per trillion trace amount occurring naturally. For example, the radioactive source can be provided within the diamond material at an atom concentration of at least 0.1%, 1%, 5%, 10%, 20%, 50%, 75%, 85%, 95%, 99%, or 99.9%. Since beta region from $^{14}C$ does not penetrate large distances within a diamond lattice, a relatively thin layer of material can be provided. This can also potentially reduce production costs. However, sufficient $^{14}C$ must be provided to generate the required electrical power output.

Figure 3:
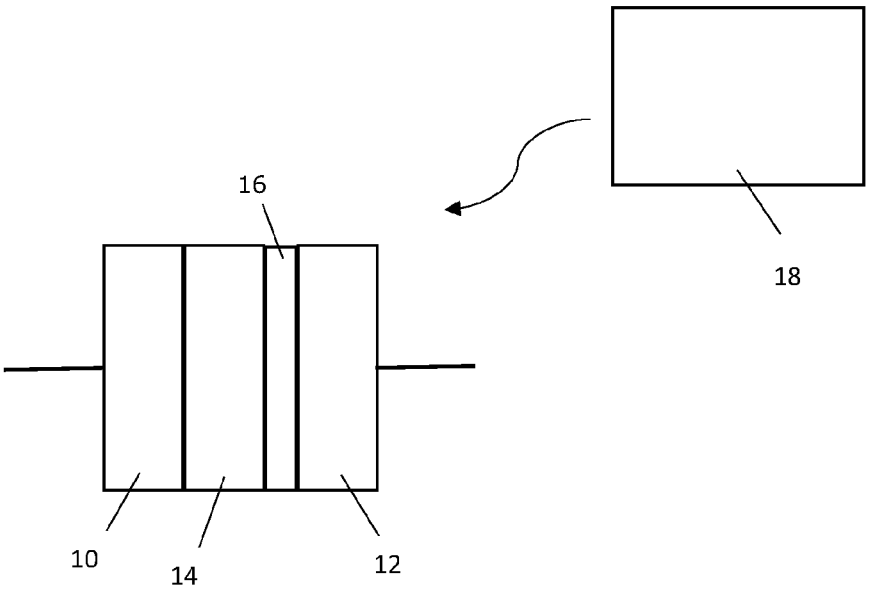
FIG. 3 shows a configuration of a radiation powered device comprising a $^{13}C$ diamond region.

FIG. 3 shows another radiation powered device configuration which comprises:

a first electrode 10;

a second electrode 12; and a semiconductor 14 disposed between the first and second electrodes, wherein the semiconductor comprises diamond material which generates a flow of electrons between the first and second electrodes when exposed to radiation, and wherein the diamond material includes a $^{13}C$ diamond region 16 which comprises isotopically purified diamond material having an increased $^{13}C$ content compared to natural isotopic abundance.

Figure 4:
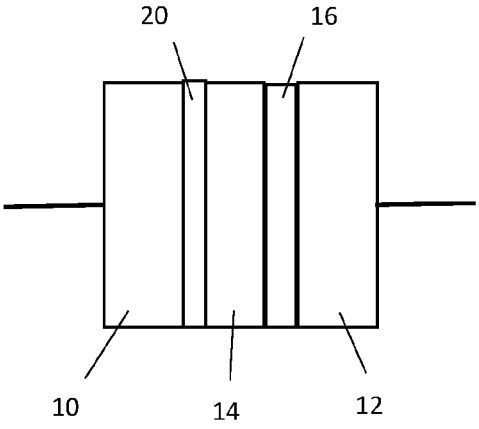
FIG. 4 shows a configuration of a radiation powered device comprising a $^{14}C$ diamond region and a $^{13}C$ diamond region.

An external radiation source 18, such as a gamma-radiation source, is shown in the configuration of FIG. 3 with the device placed in a radiation field such that electron-hole pairs are generated in the diamond material. The device may be placed adjacent the radiation source 18 or configured to surround the radiation source, e.g. by providing a cylindrical device structure within which the radiation source is disposed. An alternative to the external radiation source is to provide a radioisotope within the layered device structure as illustrated in FIG. 4 which comprises:

a first electrode 10;

a second electrode 12;

a semiconductor 14 disposed between the first and second electrodes;

a radioactive source configured to generate a flow of electrons through the semiconductor between the first and second electrodes, wherein the semiconductor 14 comprises diamond material and includes a region 20 in which the radioactive source is embedded and a $^{13}C$ diamond region 16 which comprises isotopically purified diamond material having an increased $^{13}C$ content compared to natural isotopic abundance.

Surprisingly, it has been found that the provision of a diamond material which has at least one region which is isotopically purified to increase its $^{13}C$ leads to a significant increase in output voltage when compared to a corresponding device which does not contain such a $^{13}C$ diamond layer. It is known that isotopic substitution of $^{12}C$ by $^{13}C$ increases the band-gap energy in diamond [see, for example, H Watanabe, "Isotope composition dependence of the band-gap energy in diamond" Phys. Rev. B, 88, 2013]. Providing a larger band gap region of diamond material has been found to significantly increase output voltage in a radiation powered device and can function as an electron multiplication region or layer. For example, a diamond beta-voltaic device having an output voltage of 1.4 V has been found to have an increased output voltage of 2.1 V with the introduction of a thin $^{13}C$ diamond termination layer.

By way of illustration, for a single diode device with an effective volume of $1.47\times10^{-6}$ $m^3$ (15 μm thick×25 mm diameter) containing 0.343 g of C-14 radiating half of its output into the diode, the open circuit voltage is approximately 2.0 V and the short circuit current is estimated to be 10 μA in a diamond diode using an integral 49 keV radioisotope beta source. When the diamond device structure is repeated many times in a single device then this imbues the capability for the device to act as an efficient gamma-voltaic when exposed to a high intensity gamma radiation fields.

While not being bound by theory a betavoltaic cell voltage depends on the diode leakage current which in turn depends on the Schottky barrier height and its homogeneity. The choice of high purity C-13 influences the Schottky barrier height due to the band gap of C-13 being 17 meV larger than C-12, which also influences the magnitude of the diode leakage current.

The $^{13}C$ diamond region can be provided in the form of a layer having a thickness in a range 2 nm to 2 mm, optionally 200 nanometres to 2 millimetres. Isotopically purified carbon source material is relatively expensive and thus fabricating a thick layer of isotopically purified $^{13}C$ is not desirable. In this regard, it has been found that a thin layer of such isotopically purified diamond material can provide a significant increase in output voltage without duly increasing expense.

The $^{13}C$ diamond region may can have an atomic concentration of $^{13}C$ of at least 1.1%, 5%, 10%, 20%, 50%, 75%, 85%, 95%, 99%, or 99.9%. The $^{13}C$ diamond region may can have an atomic concentration of $^{13}C$ of at least 1.5%, 2%, 3%, 4%, 5%, 10%, 20%, 50%, 75%, 85%, 95%, 99%, or 99.9%. Sufficient $^{13}C$ should be incorporated into the diamond lattice in order to increase the diamond band gap to achieve the desired increase in output voltage. However, increasing isotopic purification also increases expense in requiring a higher degree of isotopic separation of the carbon source material utilized in the diamond synthesis process.

The diamond material can also include a $^{12}C$ diamond layer (or region) which comprises a layer (or region) of diamond material which has a natural abundance of carbon isotopes to, for example, within 1.1% (or at least has a $^{13}C$ content lower that the $^{13}C$ diamond region and/or a $^{14}C$ content lower than the $^{14}C$ diamond region). The $^{12}C$ diamond layer (or region), if present, may comprises a layer (or region) of diamond material which has a substantially natural abundance of carbon, for example, within 1.1% of natural abundance of each carbon isotope. For example, the diamond material can include a tri-layer structure comprising a layer of $^{14}C$ containing diamond, a layer of $^{12}C$ diamond, and a layer of $^{13}C$ diamond. Alternatively, a more simple bi-layer device structure may be provided comprising diamond material including a layer in which a radioisotope is embedded and a layer of conventional $^{12}C$ diamond. As discussed above, the layers (or regions) of the diamond material maybe isotopic layers (or regions) within the diamond material (i.e. isotopic layers within the continuous crystal lattice of the diamond material).

The $^{12}C$ diamond layer can have a thickness in a range 200 nanometres to 2 millimetres, optionally 1 micrometre to 10 micrometres. The specific layer thickness will depend to some extent on the device configuration and application. For example, in betavoltaic configurations the diamond layer can be thin as the beta radiation does not penetrate through large thicknesses of diamond material. Alternatively, for gammavoltaic configurations the diamond layer may advantageously be thick as gamma radiation will penetrate through larger distances and a large volume of diamond material will lead to more electron-hole pairs being generated and a larger charge output. For example, the diamond material may have a thickness in a range 20 micrometres to 25 millimetres, optionally 20 micrometres to 20 millimetres, optionally 50 micrometres to 1500 micrometres.

The diamond material preferably has a single substitutional nitrogen concentration of no more than 5 ppm, 1 ppm, 500 ppb, 300 ppb or 100 ppb in at least one of the aforementioned regions thereof. Impurities, of which nitrogen is the most important, reduce charge carrier performance within the diamond lattice as is known, for example, from WO0196633. As such, the diamond material can be engineered to increase charge generation and also charge mobility and lifetime.

The electrodes may be formed of materials to generate a bias for flow of electrons from the first electrode to the second electrode via a Schottky effect. The first electrode can form an ohmic contact. Such an electrode may comprise a layer of carbide forming material and a noble metal layer. The second electrode can form a Schottky contact. Such an electrode can be formed of a low atomic number metal or alloy. For example, a metal or metal alloy formed of a metal or metals having an atomic number z of no more than 20, e.g. Al or LiAl. In certain embodiments, the second electrode can form a Schottky contact and may be formed of a metal or metal alloy formed of a metal or metals having an atomic number z of 40 or less, e.g. Zr, Al or LiAl.

It should be noted that the choice of metal used to construct the Schottky contact can be a significant factor impact device performance. Furthermore, the quality of the interface between the metal and diamond can also be important. For example, one reason for a low barrier height is the lack of homogeneity of a Schottky metal interface with an oxygen-terminated diamond surface.

While certain metals can be selected based on their ability to bond to diamond material and provide a Schottky biasing effect, it is also envisaged that electrically conductive boron doped diamond could also be used either as one or both of the first and second electrodes or as a layer within the diamond layer structure. The electronic bias may also be provided or enhanced by configuring the radiation powered device to provide a thermal bias between the first and second electrodes.

While the previous configurations have been described in relation to device structures which comprise a layer of $^{13}C$ diamond which can function as an electron multiplication layer and increase output voltage, it is also envisaged that certain devices may comprise one or more of the features as described herein without such a region of $^{13}C$ diamond. For example, according to one configuration, a radiation device is provided comprising:

- a first electrode;
- a second electrode;
- a semiconductor disposed between the first and second electrodes; and
- a radioactive source configured to generate a flow of electrons through the semiconductor between the first and second electrodes;
- wherein the semiconductor comprises diamond material; and
- wherein the radioactive source is embedded within the diamond material.

As previously described, the radiation source may be, for example, tritium, $^{14}C$, $^{10}Be$ or Phosphorus-33. Even if a region of $^{13}C$ diamond is not provided, encapsulating the radioactive source still has benefits in terms of reducing losses associated with surface interfaces, air gaps, and limited penetration into the diamond structure and reducing radiation leakage and the possibility of damage and leakage of radioactive material from the device thus improving device stability and performance and increasing the robustness and chemical inertness of the device thus reducing problems associated with toxicity and/or biocompatibility. That said, it is advantageous to combine the encapsulation configuration with the performance enhancing $^{13}C$ diamond layer so as to provide a diamond material which has a region in which a radioactive source is embedded and a region of $^{13}C$ diamond which functions as an electron multiplication layer and increases output voltage.

According to yet another configuration, a radiation powered device is provided which comprises:

- a first electrode;
- a second electrode;
- a semiconductor disposed between the first and second electrodes; and
- a radioactive source configured to generate a flow of electrons through the semiconductor between the first and second electrodes;
- wherein the semiconductor comprises diamond material; and
- wherein the radioactive source is formed of $^{14}C$.

In this configuration it has been noted that several advantageous features can also be achieved by replacing the external radioactive source with a lower toxicity radioisotope in the form of $^{14}C$ such that both the radioactive source and the semiconductor are formed of carbon material even if the $^{14}C$ is not embedded within the diamond lattice, e.g. provided as a layer of $^{14}C$ containing graphite adjacent the diamond material. Such an "all carbon" radiation source and semiconductor structure is preferable to one which, for example, uses a separate heavy metal radioisotope. However, most preferably, the radioactive source is both embedded within the diamond material forming at least a part of the diamond lattice structure and most preferably is still used in combination with a $^{13}C$ diamond layer or region for charge multiplication and increased voltage output.

Figure 5:
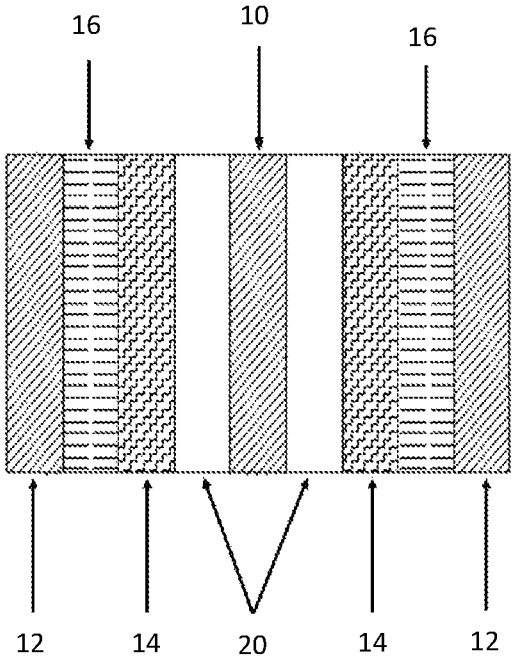
FIG. 5 shows another configuration of a radiation powered device comprising a $^{13}C$ diamond region and a $^{14}C$ diamond region in a repeat structure.

It is possible to provide multiple device structures by providing multiple layered structures in a single layer stack. An example of such a configuration is shown in FIG. 5 which includes two beta-voltaic structures in a single layer stack and sharing a common central electrode. The configuration comprises: a central electrode 10; end electrodes 12; carbon-14 diamond layers 20; carbon-12 diamond layers 14; and carbon-13 diamond layers 16. The structure thus provides two beta-voltaic devices comprising a layer structure: electrode/$^{14}C$ diamond/$^{12}C$ diamond/$^{13}C$ diamond/electrode. Multi-layered stacked device structures and/or use of thicker layers of diamond material are particularly useful in conjunction with external gamma-radiation sources as gamma radiation can penetrate through the thicker diamond layers and produce an increase in charge generation.

Figure 6:
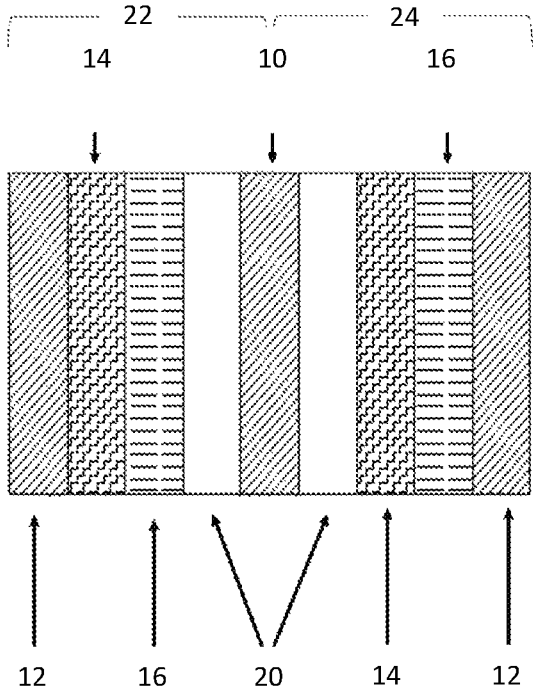
FIG. 6 shows another configuration of a radiation powered device comprising a $^{13}C$ diamond region and a $^{14}C$ diamond region including a super capacitor layered structure and a beta-voltaic layered structure.

FIG. 6 shows another configuration of a radiation powered device including a super capacitor layered structure and a beta-voltaic layered structure. The layer structure is similar to that shown in FIG. 5 with the difference that one of the two beta-voltaic devices has been modified by reversing the $^{13}C$ and $^{12}C$ layers such that one of the devices is transformed into a super capacitor. The configuration comprises: a central electrode 10; end electrodes 12; carbon-14 diamond layers 20; carbon-12 diamond layers 14; and carbon-13 diamond layers 16. The structure thus provides a beta-voltaic device 24 comprising a layer structure: electrode/$^{14}C$ diamond/$^{12}C$ diamond/$^{13}C$ diamond/electrode. The structure further comprises a super capacitor comprising the layer structure: electrode/$^{14}C$ diamond/$^{13}C$ diamond/$^{12}C$ diamond/electrode.

Figure 7:
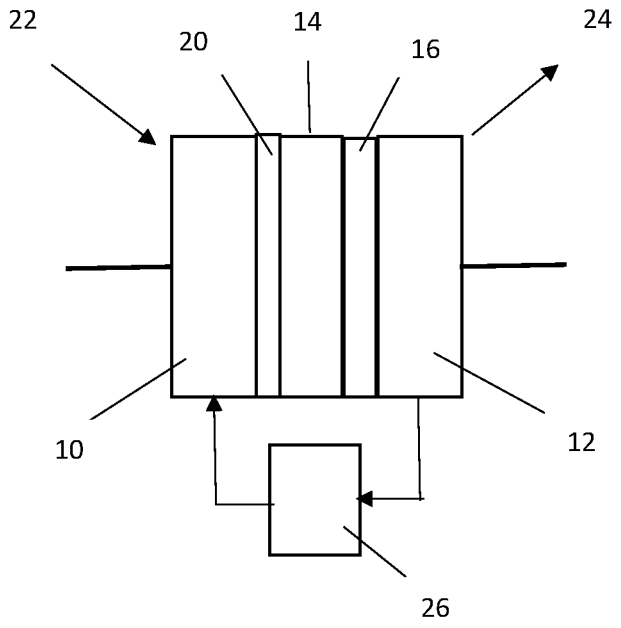
FIG. 7 shows a thermionic diamond energy converter configuration.

FIG. 7 shows a thermionic diamond energy converter configuration. The device configuration is similar to that shown in FIG. 4 and comprises: a first electrode 10; a $^{14}C$ diamond layer 20; a $^{12}C$ diamond layer 14; a $^{13}C$ diamond layer 16; and a second electrode 12. An electric load 26 is also shown coupled between the first and second electrodes with current flow as illustrated by the arrows to and from the electric load 26. In this configuration the first electrode 10 is heated 22 and the second electrode 12 is cooled 24. As such, a hot cathode 12 and a cooled collector 12 are provided to provide a thermal bias between the cathode 12 and collector 12. In one configuration heating of the cathode is provided by sunlight in order to provide a solar thermionic diamond energy converter.

Figure 8:
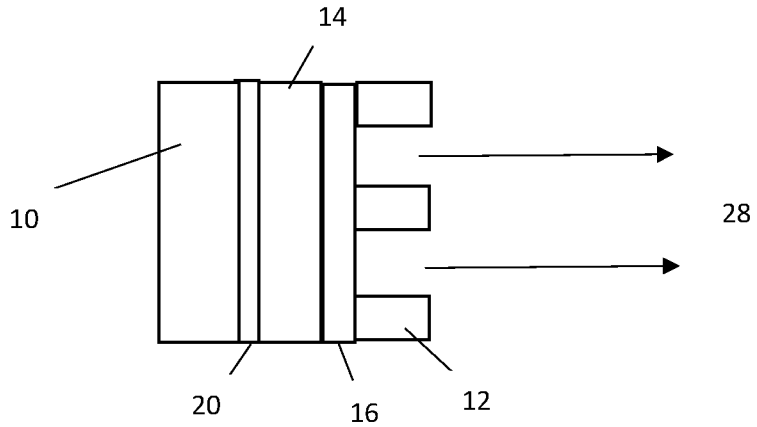
FIG. 8 shows a thermionic beta Schottky emitter configuration.

FIG. 8 shows a thermionic beta Schottky emitter configuration. Again, the device configuration is similar to that shown in FIG. 4 and comprises: a first electrode 10; a $^{14}C$ diamond layer 20; a $^{12}C$ diamond layer 14; a $^{13}C$ diamond layer 16; and a second electrode 12. The difference here is that through holes are provided in the second electrode such that hot electrons 28 can be emitted into a vacuum gap or chamber.

Figure 9:
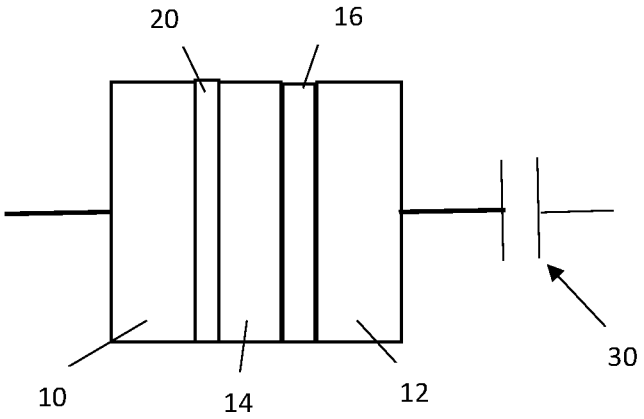
FIG. 9 shows a diamond Schottky diode beta-voltaic configuration comprising a capacitor for storing up charge.

FIG. 9 shows a diamond Schottky diode beta-voltaic configuration comprising a capacitor for storing up charge. Again, the device configuration is similar to that shown in FIG. 4 and comprises: a first electrode 10; a $^{14}C$ diamond layer 20; a $^{12}C$ diamond layer 14; a $^{13}C$ diamond layer 16; and a second electrode 12. A capacitor 30 is provided to collect a trickle charge from the layered structure such that a useful quantity of charge can be built up for subsequent use.

In general terms, a device structure can be provided which comprises:

- a first electrode;
- a second electrode; and
- a semiconductor disposed between the first and second electrodes,
- wherein the semiconductor comprises diamond material which generates a flow of electrons between the first and second electrodes when exposed to radiation without the application of a biasing voltage, and
- wherein the radiation powered device further comprises a charge storage device coupled to the first and second electrodes for storing charge flowing out of the diamond material.

In this regard, it has been found that diamond based configurations can provide charge flow when exposed to radiation without a biasing voltage. However, the charge flow is still relatively small for certain applications and thus it is advantageous to provide a charge storage device, such as a capacitor, coupled to the first and second electrodes for storing charge flowing out of the diamond material. Charge can thus be accumulated and then utilized. Charge flow can also be enhanced for charging up the charge storage device. Examples include use of a Schottky biasing effect via an electrode/diamond interface and/or thermal biasing by heating the first electrode and/or cooling the second electrode. The radiation source may be external to the device and in use the device is placed in a radiation field such as a gamma irradiation field. Alternatively, the radiation source may be incorporated into the device, for example in a manner as previously described.

While the device structures illustrated in the figures are shown in a planar layered geometry, it is also envisaged that non-planar layered structures may be provided for certain applications. For example, for radioactive waste stored in cylinders it is envisaged that the device structures as described herein can be fabricated in a cylindrical configuration such that they surround the radioactive cylinders.

It will also be understood that all the preceding configurations can be combined in a variety of different ways depending on application requirements.

Power Sources

FIG. 10 provides a pictorial representation of an electrical power source 100 as described herein. The power source 100 is a radioisotope electrical power source comprising a semiconductor 14 comprising a diamond material and a radioactive source embedded within the diamond material. In the configuration shown in FIG. 10, the radioactive source is $^{14}C$ which is substitutionally integrated into the diamond material, in this example a boron-doped diamond material. The electrical power source 100 provides electrical power as the radioactive source $^{14}C$ decays via beta emission ($e^-$).

FIG. 11 provides a pictorial representation of an electrical power source 100 as described herein. The power source 100 is a radioisotope electrical power source comprising a semiconductor 14 comprising a diamond material and a radioactive source embedded within the diamond material. In the configuration shown in FIG. 10, the radioactive source is $^{14}C$ which is substitutionally integrated into the diamond material, in this example a boron-doped diamond material. The electrical power source 100 provides electrical power as the radioactive source $^{14}C$ decays via beta emission ($e^-$).

Figure 12:
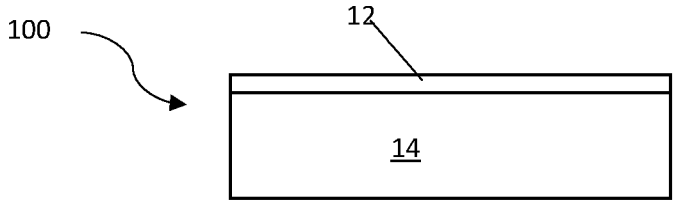
FIG. 12 is a schematic drawing of a radioisotope electrical power source.

FIG. 12 is a diagram of an electrical power source 100 as described herein. The power source 100 is a radioisotope electrical power source comprising a semiconductor 14 comprising a diamond material and a radioactive source embedded within the diamond material. The electrical power source 100 shown in FIG. 12 also comprises a Schottky metal layer 12 to provide a Schottky contact.

Methods of Manufacture

A chemical vapour deposition (CVD) technique can be used to fabricate the diamond material for incorporation into devices according to the various configurations described herein. CVD diamond synthesis is well known in the art. An example is described in WO0196633 for fabricating high purity electronic grade single crystal CVD diamond material. Such high purity synthetic diamond material is particularly useful for the devices as described herein as it has better charge mobility and charge lifetime characteristics when compared with lower purity diamond material in which impurities act as charge traps. However, it is also envisaged that other well-known diamond synthesis techniques can be used including, for example, those to produce nitrogen doped single crystal diamond materials, boron doped single crystal CVD diamond materials, and polycrystalline diamond materials.

The fabrication techniques are modified compared with standard diamond synthesis processes by utilizing isotopically purified starting materials which are incorporated into the growing diamond lattice. For example, methane or an alternative carbon containing gas can be provided in C-12, C-13, and/or C-14 form to provide a continuous single crystal CVD diamond lattice with a layered structure with varying carbon isotope concentration. Fabrication of isotopically purified layers of single crystal CVD diamond material is known in the art. What is different here is the finding that specific combinations of C-12, C-13, and C-14 diamond layers can be used to provide improved radiation powered devices with, for example, increased output voltage.

A diamond material embedded with a radioactive source may be provided by synthetically producing a diamond material in which atoms of a radioisotope are integrated (e.g. substitutionally or interstitially) during formation of the synthetic diamond material, for example by chemical vapour deposition (CVD).

In certain embodiments a diamond material may be synthetically obtained by:

providing a carbon containing gas comprising carbon atoms and a radioisotope source gas comprising radioisotope source atoms; and depositing carbon atoms and radioisotope source atoms by chemical vapour deposition to form a diamond material.

The carbon containing gas may comprise $^{12}C$, $^{13}C$, and/or $^{13}C$. In certain embodiments the carbon containing gas comprises $^{12}C$ and/or $^{13}C$. In certain embodiments the carbon containing gas comprises $^{12}C$.

The radioisotope source gas may comprise deuterium, tritium, $^{13}C$, $^{14}C$, and/or $^{33}P$. In certain embodiments, the radioisotope source gas is a radioisotope containing gas. The radioisotope containing gas may containing may contain tritium, $^{14}C$, and/or $^{33}P$. The radioisotope containing gas may containing may contain tritium and/or $^{14}C$. The radioisotope containing gas may containing may contain $^{14}C$.

The radioisotope source gas may comprise atoms of a radioisotope atoms (i.e. a radioisotope containing gas) or atoms of a non-radioactive isotope that may be converted to a radioisotope by neutron irradiation. For example, the radioisotope source gas may comprise tritium, $^{14}C$, and/or $^{33}P$ as radioisotope atoms; and/or $^{13}C$ and/or deuterium as atoms which may be converted to a radioisotope on neutron irradiation (deuterium can be converted to tritium using neutron irradiation and $^{13}C$ can be converted to $^{10}Be$ using neutron irradiation).

In certain embodiments the carbon containing gas comprises $^{12}C$ and/or $^{13}C$, and the radioisotope source gas comprises $^{14}C$, deuterium and/or tritium.

In certain embodiments the carbon containing gas comprises $^{12}C$ and/or $^{13}C$, and the radioisotope source gas comprises $^{14}C$ and/or tritium. In certain embodiments the carbon containing gas comprises $^{12}C$, and the radioisotope source gas comprises $^{14}C$ and/or tritium.

In certain embodiments the carbon containing gas comprises $^{12}C$, and the radioisotope source gas comprises $^{13}C$ and/or deuterium.

In certain embodiments the process of synthetically producing a diamond material further comprises neutron irradiating the diamond material produced by chemical vapour deposition to produce a diamond material embedded with a radioactive source. For example, the process may comprises providing a carbon containing gas comprising $^{12}C$ and a radioisotope source gas comprising $^{13}C$ and/or deuterium; depositing carbon atoms and radioisotope source atoms by chemical vapour deposition to form a diamond material; and neutron irradiating the diamond material deposited by chemical vapour deposition to form a diamond material embedded with a radioactive source, where the radioactive source is $^{10}Be$, $^{14}C$ and/or tritium.

Electrode contacts can be provided on the diamond material using a physical vapour deposition (PVD) process to permit connection to an electrical circuit. Again, metallization techniques for providing electrical contacts to diamond material are known in the art. Certain embodiments of the present invention select particular metals for the electrodes based on their ability to bias charge flow through diamond material when exposed to radiation without application of a biasing voltage.

An advantage of using tritium and/or $^{14}C$ as the radioisotope is that they are both bi-products of nuclear power plants. Tritium is formed in coolant water in nuclear power plants and water containing tritium is normally released from nuclear plants under controlled, monitored conditions. This tritium containing water can be electrolytically decomposed into oxygen and hydrogen gas including tritium. The tritium containing hydrogen gas can then be used in a hydrogen plasma chemical vapour deposition (CVD) diamond synthesis process. A hydrogen plasma CVD diamond synthesis process tends to incorporate a significant amount of hydrogen within the diamond lattice and thus using this approach a significant amount of tritium can be incorporated into the diamond lattice. In some examples, a hydrogen plasma for CVD diamond synthesis may comprise deuterium. Deuterium incorporated into the diamond lattice may be converted to tritium by neutron irradiation.

$^{14}C$ is also a bi-products of nuclear power plants and has been found to form as a surface layer on neutron irradiated graphite rods or blocks used to moderate the nuclear reaction. The $^{14}C$ can be extracted from the blocks and then converted to methane via, for example, reaction with hydrogen or a catalysed reaction with water vapour. Methane is conventionally used as the carbon source in a hydrogen plasma CVD diamond synthesis process. As such, $^{14}C$ can be used as the carbon source in such a hydrogen plasma CVD diamond synthesis process resulting in a diamond lattice incorporating $^{14}C$.

Alternatively, solid $^{14}C$ containing graphite can be placed in a CVD reactor in a location such that the plasma etches the graphite which is subsequently incorporated into the growing diamond lattice.

Alternatively still, solid graphite material comprising $^{14}C$ can be used in a high pressure high temperature diamond synthesis process which conventionally converts graphite to diamond under high pressure and temperature using a metal catalyst composition.

Using the aforementioned approaches, radioactive bi-products of nuclear power plants can be encapsulated into diamond material to render them safe and the resultant diamond material utilized, for example, to construct radioisotope batteries thus converting problematic waste materials into a useful power source.

An alternative approach to incorporate $^{14}C$ into a diamond lattice is to nitrogen dope the diamond material during synthesis and then neutron irradiate the nitrogen doped diamond material to convert $^{14}N$ into $^{14}C$. For example, a nitrogen doped C-13 layer of diamond can be grown and then irradiated to convert $^{14}N$ into $^{14}C$. The advantage of using a C-13 layer of diamond in this approach is that a small proportion of C-13 is also converted into C-14. Alternatively, it may be sufficient to nitrogen dope a natural isotopic abundance diamond material during synthesis and then neutron irradiate the nitrogen doped diamond material to convert $^{14}N$ into $^{14}C$.

Alternatively still, beryllium-10 can be incorporated into a diamond lattice by introducing a $^{13}C$ containing species into the growth plasma during CVD diamond synthesis and neutron irradiating the diamond material containing $^{13}C$ to form $^{10}Be$.

Alternatively still, it is also known that phosphorus can be incorporated into a diamond lattice by introducing a phosphorus containing species into the growth plasma during CVD diamond synthesis or by subsequent ion implantation. However, it should be noted that these doping/converting/implanting approaches will not achieve the same levels of isotopic purity as using isotopically purified starting materials.

Applications

The technology as described herein has been developed to use nuclear waste to generate electricity in a nuclear-powered batteries. The inventors have grown synthetic diamond samples that, when placed in a radioactive field, for example a gamma radiation field, are able to generate a useful electrical current. Furthermore, synthetic diamond samples have been grown which incorporate their own power source in the form of, for example, beta emitting $^{14}C$ in the diamond lattice.

These developments have the potential to solve some of the problems of nuclear waste, clean electricity generation, and battery life. Unlike the majority of electricity-generation technologies, which use energy to move a magnet through a coil of wire to generate a current, the synthetic diamond samples are able to produce a charge simply by being placed in close proximity to a radioactive source and/or incorporating their own radioisotope source. There are no moving parts involved, no emissions generated, and no maintenance required, just direct electricity generation. By encapsulating radioactive material inside diamonds, a long-term problem of nuclear waste has been turned into a nuclear-powered battery and a long-term supply of clean energy.

Initial research work demonstrated a prototype diamond battery using Nickel-63 as the radiation source. However, significantly improved efficiency has been achieved by utilising carbon-14, a radioactive version of carbon, which is generated in graphite blocks used to moderate the reaction in nuclear power plants. Research has shown that the radioactive carbon-14 is concentrated at the surface of these blocks, making it possible to process it to remove the majority of the radioactive material. The extracted carbon-14 is then incorporated into diamond material to produce a nuclear-powered battery. The UK alone currently holds almost 95,000 tonnes of graphite blocks at the time of writing and by extracting carbon-14 from these blocks, their radioactivity decreases, reducing the cost and challenge of safely storing this nuclear waste.

In accordance with certain configurations, carbon-14 is chosen as a source material because it emits a short-range radiation, which is quickly absorbed by a solid material. This make it dangerous to ingest or touch with naked skin, but when safely held within diamond material no short-range radiation can escape. In fact, since diamond is the hardest substance known to man it is the ideal material to provide safe storage of radioactive waste material.

Despite their low-power, relative to current battery technologies, the life-time of the diamond batteries described herein could revolutionise the powering of devices over long timescales. The actual amount of carbon-14 in each battery will depend on application requirements. One battery containing 1 g of carbon-14, would deliver 15 Joules per day. This is less than a standard AA battery. However, standard alkaline AA batteries are designed for short timeframe discharge: one battery weighing about 20 g has an energy storage rating of 700 J/g. If operated continuously, this would run out in 24 hours. Using carbon-14 the battery would take 5,730 years to reach 50 percent power, which is about as long as human civilization has existed.

It is envisaged that these batteries will be used in situations where it is not feasible to charge or replace conventional batteries. Applications include low-power electrical devices where long life of the energy source is needed such as pacemakers, satellites, high-altitude drones, spacecraft, seabed communications, monitoring devices etc. Another application is in systems for monitoring radioactive waste using self-powered devices. In this regard, a device as described herein could be adapted to function as both a battery and a detector by switching between non-voltage-biased and voltage-biased modes of operation. Self-powered sensor devices are envisaged for monitoring of radiation, humidity, temperature and gases, e.g. in high radiation environments. In essence, the technology is designed for applications where low power is required constantly to keep devices on/retain memory etc. and where changing a battery is not possible/inherently expensive due to the difficult location of the device. The markets include, but are not limited to: the civil nuclear sector; the 'internet of things'; space exploration; vehicle tyre pressure monitoring; and certain implanted medical devices. It is also envisaged that when using diamond material in electronic applications, the diamond material can be used both as a power source and a heat spreader or heat sink.

Yet another application is in downhole drilling. Diamond is already used as cutters on drill bits for improved drilling performance. Sensors are also provided on drill bits or drill strings for sensing numerous parameters for optimizing drilling performance. The downhole physical and chemical environment during drilling is challenging. As such, the provision of robust, radiation powered diamond devices in such applications would be advantageous in some respects over more standard power sources.

It is also envisaged that beyond the radiation powered devices as described herein, other diamond products can be provided. That is, in general terms a method of disposing of radioactive waste is provided which comprises encapsulating the radioactive waste in diamond material. The diamond material can then be utilized in a range of applications as is known in the art.

While this invention has been described in relation to certain embodiments it will be appreciated that various alternative embodiments can be provided without departing from the scope of the invention which is defined by the appending claims.

Unless otherwise stated, the features of any dependent claim can be combined with the features of any of the other dependent claims, and any other independent claim.

Aspects of the present invention may be described in the following numbered statements:

1. A radiation powered device comprising:
   a first electrode;
   a second electrode;
   a semiconductor disposed between the first and second electrodes; and
   a radioactive source configured to generate a flow of electrons through the semiconductor between the first and second electrodes;
   wherein the semiconductor comprises diamond material; and
   wherein the radioactive source is embedded within the diamond material.
2. A radiation powered device according to statement 1, wherein the radioactive source embedded within the diamond material is formed of one or more of tritium, $^{14}C$, and phosphorus-33.
3. A radiation powered device according to statement 2, wherein the radioactive source is $^{14}C$ and/or tritium.
4. A radiation powered device according to statement 3, wherein the radioactive source is $^{14}C$
5. A radiation powered device according to any preceding statement,
   wherein the diamond material has a layered structure with at least one layer comprising the radioactive source and at least one layer which does not comprise the radioactive source.

6. A radiation powered device according to statement 5, wherein the layered structure has a plurality of layers comprising the radioactive source and a plurality of layers which do not comprise the radioactive source.

7. A radiation powered device according to any preceding statement, wherein the radioactive source is provided in a layer of diamond having a thickness in a range 50 nanometres to 150 micrometres, optionally 500 nanometres to 50 micrometres.

8. A radiation powered device according to any preceding statement, wherein the radioactive source is provided within the diamond material at an atom concentration of at least 0.1%, 1%, 5%, 10%, 20%, 50%, 75%, 85%, 95%, 99%, or 99.9%.

9. A radiation powered device according to any preceding statement, wherein the diamond material includes a $^{13}C$ diamond region which comprises isotopically purified diamond material having an increased $^{13}C$ content compared to natural isotopic abundance.

10. A radiation powered device according to statement 9, wherein the $^{13}C$ diamond region is in the form of a layer having a thickness in a range 200 nanometres to 2 millimetres.

11. A radiation powered device according to statement 9 or 10, wherein the $^{13}C$ diamond region has an atomic concentration of $^{13}C$ of at least 0.1%, 1%, 5%, 10%, 20%, 50%, 75%, 85%, 95%, 99%, or 99.9%.

12. A radiation powered device according to any preceding statement, wherein the diamond material includes a $^{12}C$ diamond layer which comprises a layer of diamond material which has a natural abundance of carbon isotopes to within 1.1%.

13. A radiation powered device according to statement 12, wherein the $^{12}C$ diamond layer has a thickness in a range 200 nanometres to 2 millimetres, optionally 1 micrometre to 10 micrometres.

14. A radiation powered device according to any preceding statement, wherein the diamond material includes a tri-layer structure comprising a layer of $^{14}C$ containing diamond, a layer of $^{12}C$ diamond, and a layer of $^{13}C$ diamond.

15. A radiation powered device according to any preceding statement, wherein the diamond material has a single substitutional nitrogen concentration of no more than 5 ppm, 1 ppm, 500 ppb, 300 ppb or 100 ppb in at least one region thereof.

16. A radiation powered device according to any preceding statement, wherein the first electrode forms an ohmic contact.

17. A radiation powered device according to statement 16, wherein the first electrode comprises a layer of carbide forming material and a noble metal layer.

18. A radiation powered device according to any preceding statement, wherein the second electrode forms a Schottky contact.

19. A radiation powered device according to statement 18, wherein the second electrode is formed of a metal or metal alloy, the metal or metal alloy being formed of a metal or metals having an atomic number z of no more than 20.

20. A radiation powered device according to statement 19, wherein the second electrode is formed of Al or LiAl.

21. A radiation powered device according to any preceding statement, wherein the diamond material has a thickness in a range 20 micrometres to 25 millimetres, optionally 20 micrometres to 20 millimetres, optionally 50 micrometres to 1500 micrometres.

22. A radiation powered device according to any preceding statement, wherein the radiation powered device is configured to provide a thermal bias between the first and second electrodes.

23. A radiation powered device according to any preceding statement, further comprising a charge storage device coupled to the first and second electrodes for storing charge flowing out of the diamond material.

24. A radiation powered device comprising:

a first electrode;

a second electrode; and a semiconductor disposed between the first and second electrodes, wherein the semiconductor comprises diamond material which generates a flow of electrons between the first and second electrodes when exposed to radiation, and wherein the diamond material includes a $^{13}C$ diamond region which comprises isotopically purified diamond material having an increased $^{13}C$ content compared to natural isotopic abundance.

25. A radiation powered device comprising:

a first electrode;

a second electrode;

a semiconductor disposed between the first and second electrodes; and a radioactive source configured to generate a flow of electrons through the semiconductor between the first and second electrodes;

wherein the semiconductor comprises diamond material; and wherein the radioactive source is formed of $^{14}C$.

26. A radiation powered device comprising:

a first electrode;

a second electrode; and a semiconductor disposed between the first and second electrodes, wherein the semiconductor comprises diamond material which generates a flow of electrons between the first and second electrodes when exposed to radiation without the application of a biasing voltage, and wherein the radiation powered device further comprises a charge storage device coupled to the first and second electrodes for storing charge flowing out of the diamond material.

27. A method of disposing of radioactive waste comprising encapsulating the radioactive waste in diamond material.

28. A method according to statement 27, wherein the radioactive waste is $^{14}C$ or tritium.

The invention claimed is:

1. An electrical power source comprising a semiconductor, the semiconductor comprising a diamond material and a radioactive source embedded within the diamond material, wherein the radioactive source comprises a beta-emitting radioisotope and atoms of the radioisotope are substitutionally or interstitially integrated into the diamond material, wherein the diamond material comprises a plurality of regions in the form of layers within a continuous crystal lattice of the diamond material, and wherein at least one layer of the diamond material comprises the radioactive source and at least one layer of the diamond material does not comprise the radioactive source.

2. The electrical power source of claim 1, wherein the radioactive source embedded within the diamond material is formed of one or more of tritium, $^{14}C$, $^{10}Be$ and phosphorus-33.

3. The electrical power source according to claim 1, wherein the diamond material has a layered structure with at least one layer comprising the radioactive source and at least one layer which does not comprise the radioactive source.

4. The electrical power source according to claim 1, wherein the radioactive source is provided in a layer of diamond having a thickness in a range 50 nanometres to 150 micrometres.

5. The electrical power source according to claim 1, wherein the diamond material includes a $^{13}C$ diamond region which comprises isotopically purified diamond material having an increased $^{13}C$ content compared to natural isotopic abundance.

6. The electrical power source according to claim 5, wherein the $^{13}C$ diamond region is in the form of a layer having a thickness in a range 2 nanometres to 2 millimetres.

7. The electrical power source according to claim 5, wherein the $^{13}C$ diamond region has an atomic concentration of $^{13}C$ of at least 2%, 3%, 4%, 5%, 10%, 20%, 50%, 75%, 85%, 95%, 99%, or 99.9%.

8. The electrical power source according to claim 1, wherein the diamond material includes a $^{12}C$ diamond layer comprising a boron-doped $^{12}C$ diamond layer.

9. The electrical power source according to claim 8, wherein the $^{12}C$ diamond layer has a thickness in a range 200 nanometres to 2 millimetres.

10. The electrical power source according to claim 1, wherein the diamond material includes a tri-layer structure comprising a layer of $^{14}C$ containing diamond, a layer of $^{12}C$ diamond, and a layer of $^{13}C$ diamond.

11. The electrical power source according to claim 1, wherein the diamond material has a layered structure comprising one or more layers of the diamond material, and wherein at least one layer of the one or more layers comprises an isotopic layer within the diamond material.

12. The electrical power source according to claim 1, wherein the diamond material has a single substitutional nitrogen concentration of no more than 5 ppm, 1 ppm, 500 ppb, 300 ppb or 100 ppb in at least one region thereof.

13. The electrical power source according to claim 1, wherein the diamond material in which a radioactive source is embedded is a synthetic diamond material in which radioisotope atoms are integrated during formation of the synthetic diamond material.

* * * * *